US005676283A

United States Patent [19]

Wang

[11] Patent Number: 5,676,283

[45] Date of Patent: Oct. 14, 1997

[54] POWER DEVICE FOR A PERFUME SPRAYER

[75] Inventor: Alex Wang, Taipei, Taiwan

[73] Assignee: Kae Chuang International Co., Ltd., Taipei, Taiwan

[21] Appl. No.: 676,472

[22] Filed: Jul. 8, 1996

[51] Int. Cl.[6] ..... G04C 23/42

[52] U.S. Cl. ..... 222/649; 222/648

[58] Field of Search ..... 222/639, 648, 222/649, 63

[56] References Cited

U.S. PATENT DOCUMENTS

Re. 34,847 2/1995 Muderlak et al. ..... 222/649 X 3,589,563 6/1971 Carragan ..... 222/648

3,643,836 2/1972 Hunt ..... 222/648

3,739,944 6/1973 Rogerson ..... 222/649

*Primary Examiner*—Gregory L. Huson

*Attorney, Agent, or Firm*—Harrison & Egbert

[57] ABSTRACT

A vertical pushing device for a perfume sprayer having a base member, a motor connected to the base member, an eccentric gear linked to the motor, a sliding block connected to a guide rail to the base, a switch member connected to the motor and interactive with a movement of a push board of the sliding block, and a controller for actuating the motor in response to signals from the switch. The push board of the sliding block contacts the nozzle of the perfume cannister so as to dispense perfume relative to a movement of the sliding block. The sliding block has a long hole which receives the eccentric gear therein.

2 Claims, 3 Drawing Sheets

POWER DEVICE FOR A PERFUME SPRAYER

BACKGROUND OF THE INVENTION

1. Field of the Invention

The invention relates to a power device for a perfume sprayer. More particular, the present invention relates to a device which can be pushed up and down vertically to control the spray amount of the perfume.

2. Prior Art

A conventional power device for a perfume sprayer uses a gear board as a rocking bar to push down a nozzle of a freshener.

When the nozzle is suddenly pushed down to the lowest end, because a motor is bearing a sudden resistance, the motor will induce a circuit to stop the motion of the motor, and push it up back to the highest point. Since it is under continual over-pressure, the movement is in accordance with electronic induction. As a result, much unnecessary power is wasted and its battery loss is tremendous. Also, this movement has no alternative; that is, after each push, the nozzle must return to its original point.

SUMMARY OF THE INVENTION

To save unnecessary losses and to increase alternatives for the cycling of push and movement, the present invention provides a power device of mechanical control. By means of that, when push movement reaches a set point, it will automatically stop to avoid unnecessary losses. Also, positions for the push mechanism to stop the power can be located either on an upper portion to open the nozzle of the freshener, or on a lower portion to close it. In other words, when the nozzle of freshener is pushed down, it will constantly remain open, and when it is not pushed down, it will be closed. In this way, the power gear can control the spray time, and no unnecessary power will be wasted.

The present invention provides a vertical pushing power device for a perfume sprayer. It is comprised of a base, a gear unit, an eccentric gear, sliding blocks, and a circuit board switch. The base is a case for all power members, including a motor, a circuit board, a gear pin, a guide rail for the sliding block, and switch sockets. At the bottom of the base, there extends a clamping mouth shaped like a "c". The gear unit is mounted on the base driven by motors and is linked to a power transmission mechanism of an eccentric. A set of sliding blocks of an eccentric is an eccentric gear set in a long hole in the center of a sliding block. When the eccentric gear rotates, the sliding block will move up and down vertically. A push board extends from one side of the sliding block. A feature of the present invention is that a pair of "C" shaped retainers hold the freshener firmly at a positioning point. The sliding block works effectively and so moves up and down vertically. The bottom surface is a contact surface to push down the nozzle of the freshener. An upper starting point on the push board of the sliding block is a positioning point to push the switch to stop the power gear when it completes a period of movement.

The vertical pushing power device for a perfume sprayer, as mentioned above, has the two switches which are respectively fixed on the upper starting point on the push board of the sliding block so as to make the nozzle pushing movement to become two semi-periods which alternately move.

BRIEF DESCRIPTION OF THE DRAWING FIGURES

FIG. 1 is a pictorial view of a preferred embodiment.

FIG. 2*a* is a cross-sectional end view of the structure of the present invention.

FIG. 2*b* is a cross-sectional side view of the structure of the present invention.

FIG. 2*c* is a cross-sectional plan view of the structure of the present invention.

DETAILED DESCRIPTION OF THE PREFERRED EMBODIMENTS

Figure 1:
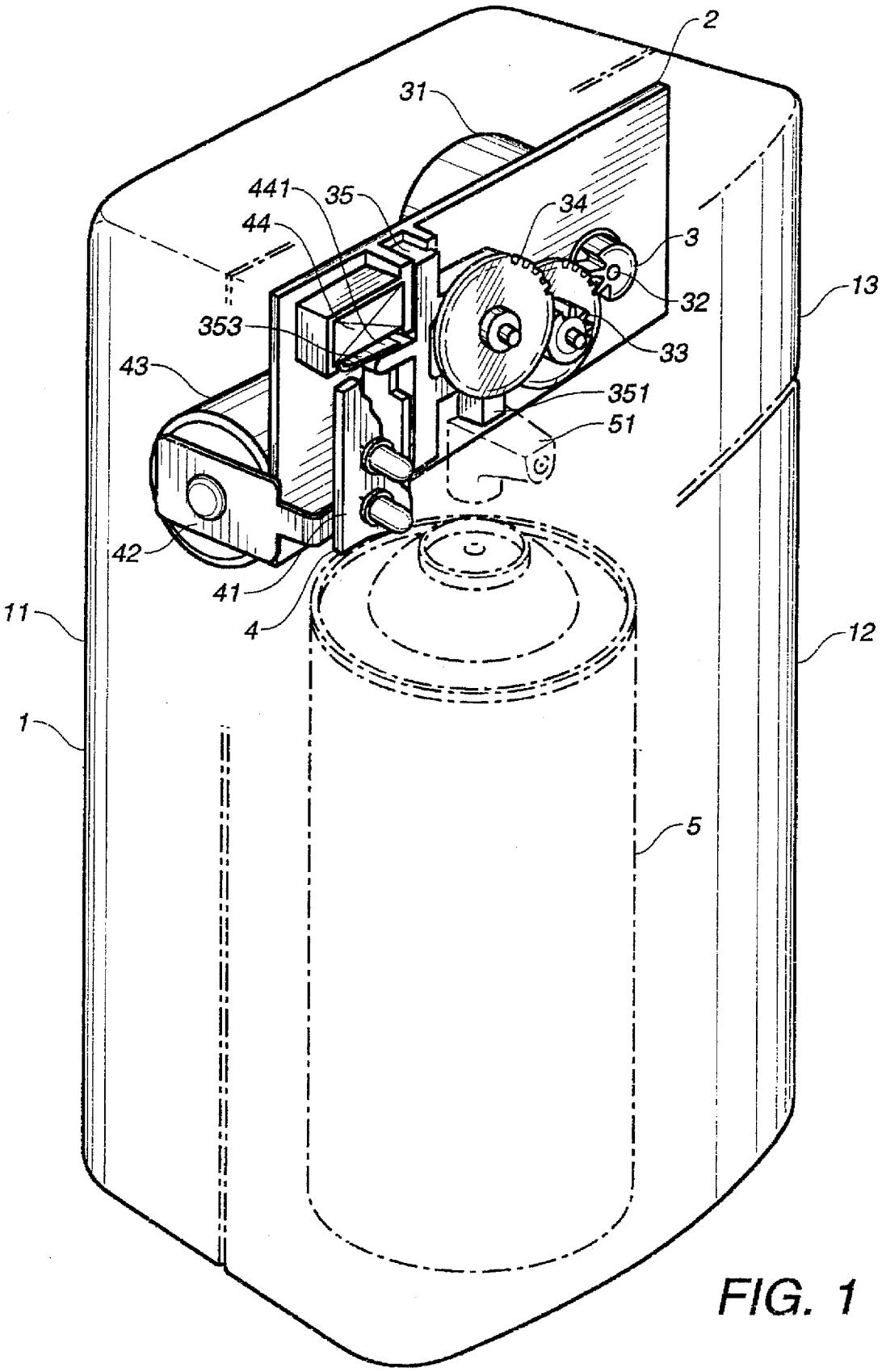

As shown in FIG. 1, the present invention is a power gear which is mounted on the upper portion of a perfume sprayer and which can supply a push motion moving vertically up and down. The perfume sprayer is comprised of a main body (1), a base (2) for a power device, a power gear (3), and an electric controller (4). The main body (1) includes a back cover (11), a front cover (12), and a case (13). The power gear (3), base (2), and electric controller (4) are accommodated in case (13). In other words, they are mounted on the upper portion of the main body (1). The lower section of the main body (1) accommodates a disposable freshener. A sliding block (35)—is used to push down a nozzle on the top of the freshener (5). When the sliding block (35) moves down, the nozzle (51) will be pushed down to spray perfume out of the freshener. When the gliding block (35) moves upward, nozzle (51) will automatically pop up to close the mouth of the freshener and prevent the perfume from being sprayed out.

Figure 2A:
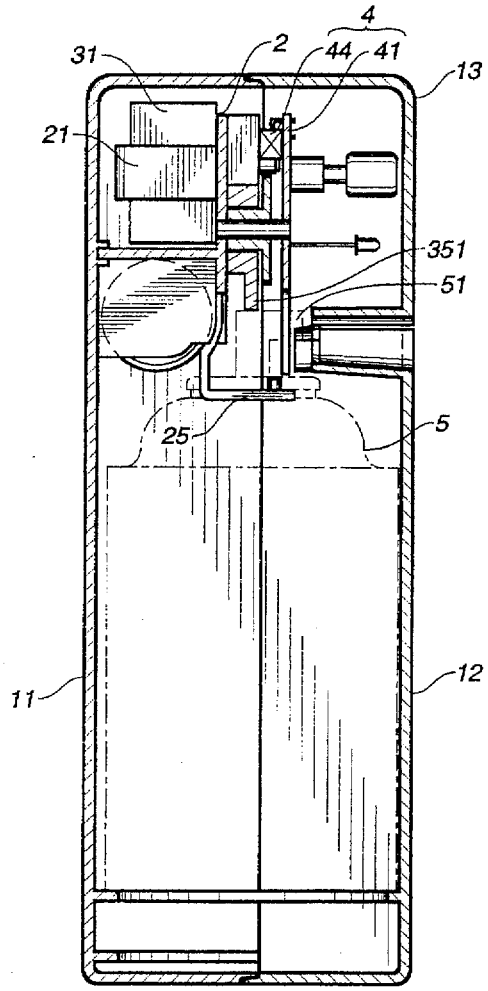
Figure 2B:
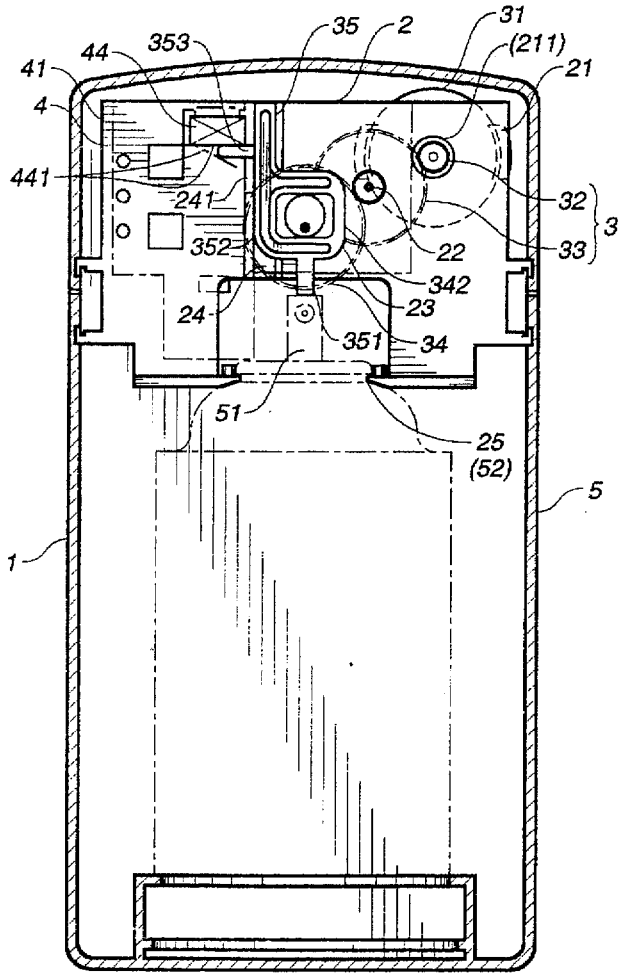
Figure 2C:
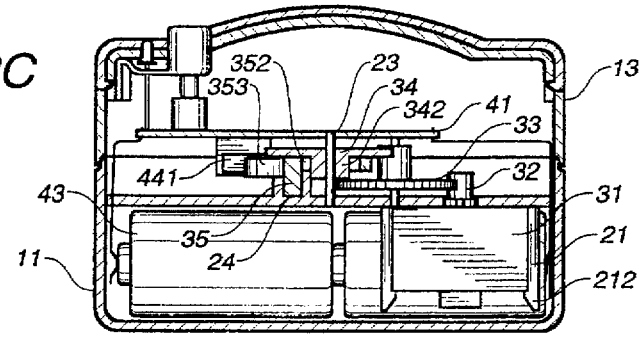

As shown in FIG. 2, the elements and parts of the above mentioned power device are combined and displayed. The base (2) is a support and accomodates each power member. A support (21) for the motor is fixed on the right side of base (2). A shaft hole (211) penetrates through the support. A pair of hooks (212) are mounted on the support (21) and the main body of the motor is retained by hooks (212). The shaft of the motor is retained by hooks (212). The shaft of the motor extends outside of the base through shaft hole (211). A small gear (32) is set on the motor shaft. On the left side of the motor support, there is a pair of shaft pins (22, 23), and a gear (33) is set on the shaft pin (22) and a terminal gear (34) is slidingly set on the shaft pin (23) to form a unit of reduction gears. An eccentric gear (342) is provided on a terminal gear (34). On the side of the shaft pin (23) of the terminal gear, there is disposed a sliding notch (24) which receives a sliding block (35). The main body of the block (35), shaped like a long board, has a follow board (353) extending from its left side. The sliding block (35) has a long hole (352) at its center, and an eccentric (342) is slidingly set in the long hole (352). The eccentric (342) is pushed along the upper and lower walls of the long hole (352) and moves vertically up and down in the sliding notch (24).

A clamping mouth (25), shaped like a mouth, is used to clamp the neck (52) of sprayer (5) so as to keep a steady distance between the sprayer (5) and sliding block (35). The sliding notch (24) has a notch opening (241) on its left side so as to let the follow board (353) of the sliding block (35) extend out of the notch opening (241). A circuit panel (41)

of an electric controller (4) and a battery (43) can be fixed on the base (2). In particular, one of the two switches (44) or (44, 45) used to stop its motion can be fixed on the circuit. The switch (44, 45) can be moved by the push or touch from the follow board (353).

Figure 3:
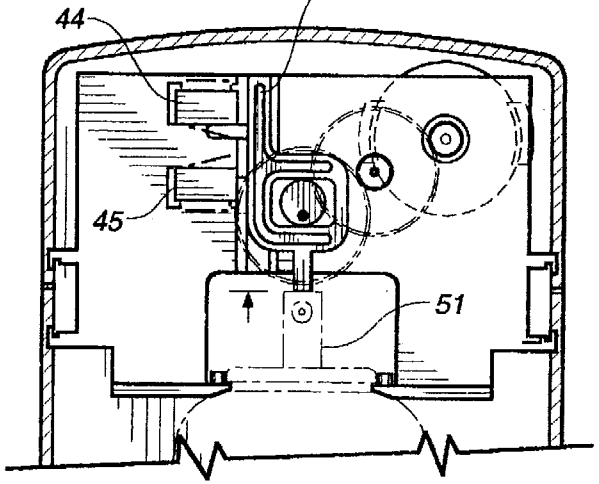
FIG. 3 is a view of a movement of the nozzle pushing mechanism.

As shown in FIG. 3, when only one stop switch (44) is provided on the upper portion of the base (2), and when sliding block (35) reaches the starting point, the follow board (353) will push down the switch (44) to start the circuit so as to stop the starting power gear (3) of the switch motor, and then the circuit waits until the next direction to start the motor, and so a period of motion is completed. When each period is in motion, the follow board (353) will move away from the switch (44) and then return to push down the switch, so a periodic motion will be completed from its moving away to its returning.

As shown in FIG. 3, the switch (44) is designed in a way that each time the sprayer sprays perfume, the sliding block (35) will push down the nozzle (51) once, and then it will return to its original point immediately.

Figure 4:
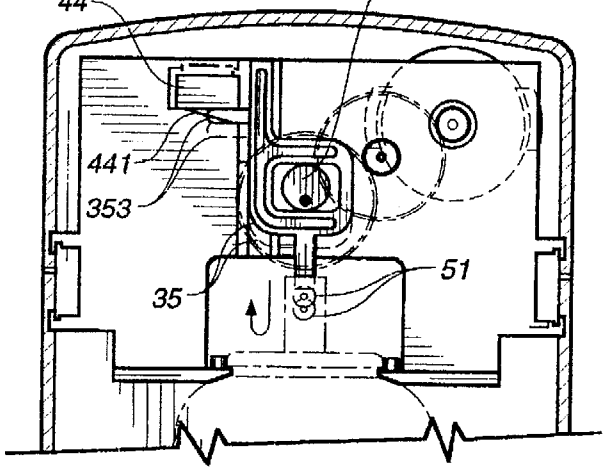
FIG. 4 is a view of another movement of the nozzle pushing mechanism.
Figure 5:
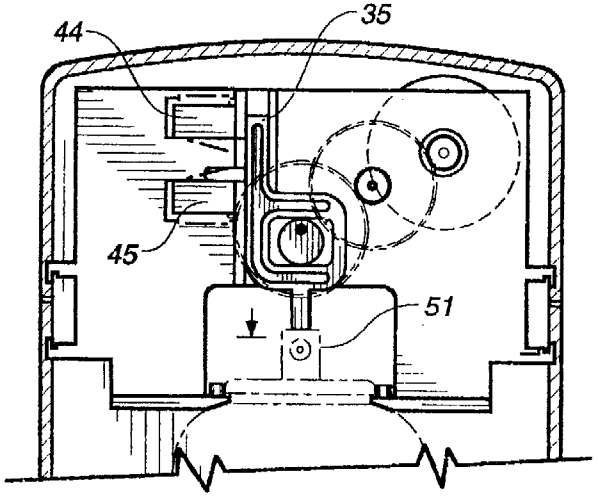
FIG. 5 is a view of the other movement of the nozzle pushing mechanism.

As shown in FIGS. 4 and 5 there are two switches (44, 45) disposed on the upper and lower starting points of the sliding block (35). The sliding block (35) is at rest either when it reaches the upper starting point or when it reaches the lower starting point. In other words, when sliding block (35) is in semi-periodic motion, it means that nozzle (51) will keep a period of rest, or it means that when nozzle (51) is pushed down, it keeps open permanantly. When it returns and extends to keep itself closed, the period of spray can be controlled by controlling the rest period of the lower starting point; in this way, the amount of spraying perfume can be controlled.

Above all, the present invention, a power device for perfume sprayer of vertical pushing type, can adjust the amount of perfume that is sprayed. This kind of function is superior to the conventional fresheners. When the nozzle is pushed down, the power gears of the present invention can be maintained at the lower starting point of the eccentric, such that it sprays continually. Under such circumstances, there is no excessive use of power to maintain the continuous spraying. The present invention reduces power consumption and operates more efficiently than conventional sprayers.

I claim:

1. A vertical pushing device for a perfume sprayer, the perfume sprayer being of the type having a housing, a perfume cannister retained in the housing, the perfume cannister having a nozzle thereon, the device comprising:

a base member;

a motor connected to said base member and shaft extending outwardly therefrom;

an eccentric gear linked to said shaft of said motor, said eccentric gear being rotatable relative to a rotation of said shaft, said eccentric gear being supported by said base;

sliding block means connected by a guide rail to said base, said sliding block means having a long hole formed centrally therein, said long hole receiving said eccentric gear therein, said sliding block means for moving vertically upwardly and downwardly relative to a rotation of said eccentric gear, said sliding block means having a push board extending from one side thereof, said push board having a push surface contacting a top surface of the nozzle, said push board movable between an upper starting point and a lower point, said push board of said sliding block means movable to said lower point so as to dispense perfume from the perfume cannister;

a pair of C-shaped retainers connected to said base for securing the perfume cannister firmly at a positioning point;

a switch means affixed to said base and electrically connected to said motor, said switch means for stopping said motor when said push board of said sliding block means reaches said upper stopping point; and a control means connected to said motor and to said switch means, said control means actuating said motor after a desired period of time.

2. The device of claim 1, said switch means comprising:

a first switch fixed at said upper starting point of said push board; and a second switch fixed at said lower point of said push board, said first and second switches being actuable so as to cause a signal to be transmitted to said control means relative to a movement of said push board.

* * * * *